US011203941B2

(12) United States Patent
Nakano et al.

(10) Patent No.: US 11,203,941 B2
(45) **Date of Patent: *Dec. 21, 2021**

(54) STEAM TURBINE

(71) Applicant: Mitsubishi Power, Ltd., Yokohama (JP)

(72) Inventors: Susumu Nakano, Yokohama (JP); Koji Ishibashi, Yokohama (JP); Shunsuke Mizumi, Yokohama (JP); Masaki Matsuda, Yokohama (JP); Takeshi Kudo, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/016,602

(22) Filed: Sep. 10, 2020

(65) Prior Publication Data

US 2020/0408098 A1 Dec. 31, 2020

Related U.S. Application Data

(60) Continuation of application No. 16/184,078, filed on Nov. 8, 2018, now Pat. No. 10,794,196, which is a (Continued)

(30) Foreign Application Priority Data

Nov. 21, 2013 (JP) ..... 2013-241034

(51) Int. Cl.
*F01D 5/14* (2006.01)
*F01D 25/32* (2006.01)
*F01D 5/28* (2006.01)

(52) U.S. Cl.
CPC ..... *F01D 5/28* (2013.01); *F01D 5/147* (2013.01); *F01D 25/32* (2013.01); *F05D 2240/122* (2013.01)

(58) Field of Classification Search
CPC . F01D 5/28; F01D 5/147; F01D 25/32; F05D 2240/122
(Continued)

(56) References Cited

U.S. PATENT DOCUMENTS 1,687,103 A * 10/1928 Meyer ..... F01D 25/32 415/169.4
1,829,674 A * 10/1931 Rosenlocher ..... F01D 25/32 96/188
(Continued)

FOREIGN PATENT DOCUMENTS

CN 103628929 A 3/2014
DE 10 2011 080 187 A1 2/2013
(Continued)

OTHER PUBLICATIONS

Extended European Search Report issued in European Application No. 20203889.9 dated Jan. 11, 2021 (12 pages).
(Continued)

*Primary Examiner* — Woody A Lee, Jr.
*Assistant Examiner* — Brian Christopher Delrue
(74) *Attorney, Agent, or Firm* — Crowell & Moring LLP

(57) ABSTRACT

A stationary blade includes a main unit having a hollow blade structure formed from a metal plate by plastic forming. The stationary blade includes a blade tail section. In a blade tail upper portion, the metal plate has a concave-shaped recess and a rib formed on an inner surface side thereof, and the metal plate further has slits formed by slitting on a blade pressure side thereof, so that droplets affixed on a blade surface can be guided into an inside of the hollow blade when the blade tail section is joined to the hollow blade main unit. The recess in the metal plate is covered so as to be lidded by a suction-side protrusion of a suction-side metal plate from a blade suction side to thereby form a hollow
(Continued)

blade tail section. The metal plates are welded together to the main unit.

17 Claims, 8 Drawing Sheets

Related U.S. Application Data division of application No. 14/548,341, filed on Nov. 20, 2014, now Pat. No. 10,145,248.

(58) Field of Classification Search
USPC ..... 415/121.2
See application file for complete search history.

(56) References Cited

U.S. PATENT DOCUMENTS 1,935,451 A * 11/1933 Jones ..... F01D 25/32 60/677
2,111,878 A * 3/1938 Van Tongeren ..... F01D 25/32 415/169.4
2,121,645 A * 6/1938 Warren ..... F01D 25/32 415/144
3,058,720 A * 10/1962 Hart ..... F01D 25/32 415/169.4
3,301,529 A * 1/1967 Wood ..... F01D 25/32 415/169.3
3,306,575 A * 2/1967 Frankel ..... F01K 7/226 415/115
3,318,077 A * 5/1967 Skopek ..... F01D 25/32 55/447
3,672,787 A * 6/1972 Thorstenson ..... F01D 5/184 416/97 R
5,342,172 A * 8/1994 Coudray ..... F01D 5/186 416/95
5,352,091 A * 10/1994 Sylvestro ..... F01D 5/189 416/96 A
6,305,902 B1 * 10/2001 Konishi ..... F01D 25/32 415/115
7,422,415 B2 * 9/2008 Burdgick ..... F01D 5/145 415/1
8,851,844 B2 * 10/2014 Yamashita ..... F01D 5/16 416/96 A
2007/0014670 A1 * 1/2007 Maeno ..... F01D 9/041 416/232
2011/0135447 A1 * 6/2011 Guo ..... F01D 9/041 415/115
2013/0028727 A1 * 1/2013 Shinoda ..... F01D 9/02 415/208.1
2014/0030065 A1 * 1/2014 Nakano ..... F01D 25/32 415/115
2014/0178206 A1 * 6/2014 Gohler ..... B23K 26/34 416/241 R

FOREIGN PATENT DOCUMENTS

EP 2 692 990 A2 2/2014
EP 2692990 A2 * 2/2014 ..... F01D 25/32
FR 2 099 389 A5 3/1972
JP 61-142102 U 9/1986
JP 1-110812 A 4/1989
JP 11-336503 A 12/1999
JP 2007-23895 A 2/2007
SU 771 350 A1 10/1980
SU 771350 A1 * 10/1980
SU 848708 A1 7/1981

OTHER PUBLICATIONS

European Search Report dated Mar. 25, 2015 (Six (6) pages).
English-language Translation of Chinese Office Action issued in counterpart Chinese Application No. 201410664318.X dated Nov. 22, 2016 (Five (5) pages).
European Communication pursuant to Article 94(3) EPC issued in counterpart European Application No. 14 193 986.8 dated Nov. 7, 2019 (five (5) pages).

* cited by examiner

STEAM TURBINE

CROSS REFERENCE TO RELATED APPLICATIONS

This application is a Continuation of U.S. application Ser. No. 16/184,078, filed Nov. 8, 2018 which is a divisional of U.S. application Ser. No. 14/548,341, filed Nov. 20, 2014, now patented as U.S. Pat. No. 10,145,248, issued Dec. 4, 2018, which claims priority from Japanese Patent Application No. 2013-241034, filed Nov. 21, 2013, the disclosures of which are expressly incorporated by reference herein.

BACKGROUND OF THE INVENTION

1. Field of the Invention

The present invention relates to a steam turbine.

2. Description of Related Art

In the last stage or a stage one or two stages there before of a low pressure turbine, pressure is generally extremely low and steam as a working fluid is in a state of wet steam that includes condensed fine droplets (droplet nuclei). The droplet nuclei condensed and deposited on a blade surface coalesce together to form a liquid film on the blade surface. The liquid film is torn off by steam of a working fluid main stream and sprayed downstream as coarse droplets, each droplet being considerably larger in size than the initial droplet nucleus. The coarse droplets, while being thereafter broken up into smaller sizes by the main stream steam, maintain certain sizes and flow downwardly. Unlike steam, the coarse droplets are unable to make a sharp turn along a flow path due to its inertia force and collide against a downstream moving blade at high speeds. This causes erosion in which the blade surface is eroded or impedes turbine blade rotation, resulting in loss.

To prevent an erosive action by the erosion phenomenon, known arrangements are to coat a leading end of a moving blade leading edge with a shielding member formed from a hard, high-strength material such as Stellite. Alternatively, as disclosed in JP-UM-61-142102-A, one known method processes the surface of the leading edge portion of the blade to form a coarse surface with irregularities, thereby reducing an impact force upon collision of droplets with the blade.

It should, however, be noted that workability involved in each individual case does not always permit the mounting of the shielding member. Moreover, the mere protection of the blade surface is not generally a perfect measure against erosion and is typically combined with other erosion prevention measures.

Generally speaking, the most effective way to reduce effects of erosion is to remove the droplets. Exemplary methods in the above-described approach are disclosed in JP-1-110812-A and JP-11-336503-A, in which a hollow stationary blade has slits formed in its blade surface and the hollow stationary blade is decompressed to thereby suck a liquid film. The slits are very often machined directly in the blade surface of the stationary blade having a hollow structure. A still another method is, as disclosed in JP-2007-23895-A, to machine an independent member that has a slit portion formed therein and to attach the independent member to the stationary blade.

SUMMARY OF THE INVENTION

A tail section including a trailing edge of the blade commonly has a sharp shape with a thin wall thickness. Thus the hollow structure of the blade can be formed by bending a single sheet and joining ends of the sheet at the blade tail section or a hollow section can be hollowed out of a solid member. However, even if any of the above-mentioned techniques are adopted, the slit that extends into the blade hollow space from the blade surface, such as those described in JP-1-110812-A and JP-11-336503-A, needs to be machined at a position spaced a certain distance away from the blade trailing edge due to the reason in machining.

With the method of machining the independent member having a slit portion therein and attaching the independent member to the stationary blade, as disclosed in JP-2007-23895-A, the slit again needs to be machined at a position spaced a certain distance away from the blade trailing edge, as in the other examples cited above, in order to obtain a sharp blade tail shape and to form a path that leads the droplet from the slit to the hollow section.

Meanwhile, the slit position is crucial to efficient removal of the liquid film. For example, steam builds up its speed downstream of the stationary blade, so that a moisture content accumulating on the blade surface increases. As a result, when the slit position is restricted by the blade structure as in the conventional methods of machining the slits, the moisture content can accumulate again on the blade to form a liquid film even at a position downstream of the slit, and not a sufficiently downstream region.

Moreover, because the steam flow velocity increases in an area having a slit, the liquid film may be torn off by the steam flow, splashing from the blade surface. In this case, the moisture content that has left the blade surface cannot be removed by the decompression and suction through the use of the slit.

To form a slit in the trailing edge of a hollow stationary blade, the blade tail section needs to be manufactured separately from the blade main unit and be later assembled with the blade main unit. The blade tail section and the blade main unit are joined with each other by welding. Welding is performed during the assembly of a blade tail member and the joining of the blade tail section with the blade main unit.

During the welding process performed to join the hollow blade with the blade tail section having a slit therein, thermal stress during the welding process tends to affect the slit in a thin-wall portion, causing the thin-wall portion to be thermally deformed. In the assembly of the blade tail member, too, the similar problem occurs if welding is employed for the assembly. The thermal deformation during welding can change the position or the shape of the slit. The deformation, if it is considerable, not only reduces efficiency in separation of the moisture content by the slit, but also accompanies an increased amount of steam as a result of a slit width increasing with the thermal deformation, resulting in reduced turbine efficiency.

It is an object of the present invention to provide a steam turbine capable of reducing an erosive action on a moving blade due to erosion arising from collision of droplets produced from wet steam, offering enhanced reliability, and preventing reduction in turbine efficiency.

While the present invention includes a plurality of means of solving the foregoing problem to solve the foregoing problem, in one aspect, the present invention provides a steam turbine including a turbine stage that comprises a stationary blade having a slit in a wall surface thereof, the slit guiding a droplet affixed to the wall surface into an inside of the stationary blade, and a moving blade disposed downstream of the stationary blade in a flow direction of a working fluid. In this steam turbine, the stationary blade comprises: a main unit having a hollow blade structure formed from a metal plate by plastic forming; and a blade tail section formed of a blade suction-side metal plate overlapping a blade pressure-side metal plate, the blade pressure-side metal plate having a recess formed in part thereof on a side adjacent to the blade suction-side metal plate, and the slit is disposed at a position at which the recess in the blade pressure-side metal plate of the blade tail section is disposed.

The present invention enables the slit for removing the liquid film formed on the wall surface of the stationary blade to be disposed at a position near the trailing edge of the stationary blade without being affected by deformation during machining, so that the liquid film can be sufficiently removed. The erosive action on the moving blade by erosion can thus be reduced for enhanced reliability. Moreover, the present invention can reduce accompanying steam and prevent reduction in turbine performance.

DESCRIPTION OF THE PREFERRED EMBODIMENT

Figure 1:
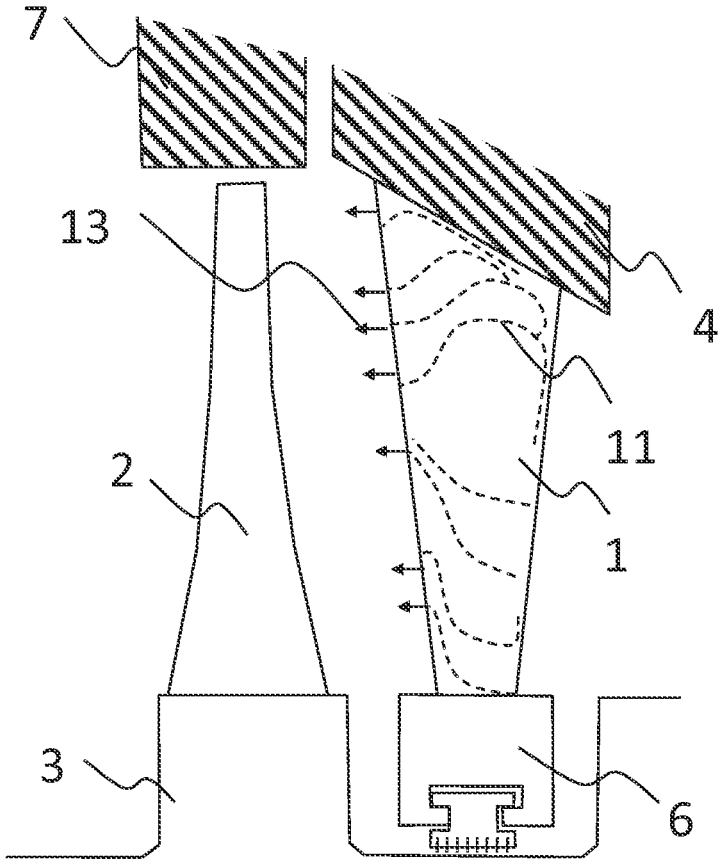
FIG. 1 is a schematic view illustrating a stage in a steam turbine and how a liquid film flows over a stationary blade surface.
Figure 2:
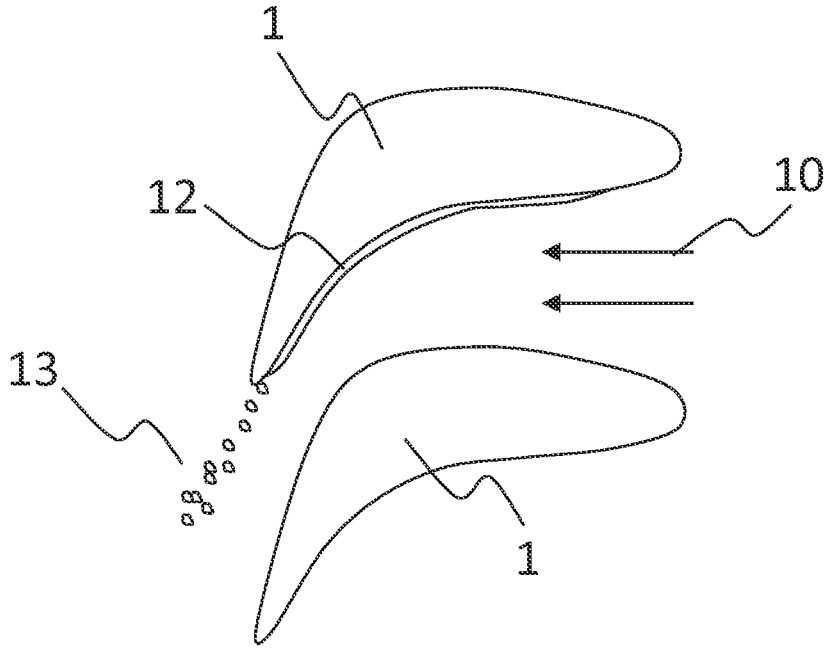
FIG. 2 is a cross-sectional view of an inter-blade flow path, illustrating schematically how droplets splash from the liquid film that has developed on the stationary blade surface in the steam turbine.

The following describes with reference to FIGS. 1 and 2 how a liquid film and droplets occur on a turbine blade surface.

FIG. 1 is a schematic view illustrating a stage in a steam turbine and how a liquid film that has developed on a wall surface of a stationary blade flows. FIG. 2 is a cross-sectional view of an inter-blade flow path, illustrating schematically how droplets splash from the liquid film that has developed on the stationary blade surface.

Reference is made to FIG. 1. A turbine stage of the steam turbine includes a stationary blade 1 and a moving blade 2. The stationary blade 1 is fixed in place by an outer peripheral side diaphragm 4 and an inner peripheral side diaphragm 6. The moving blade 2 is fixed to a rotor shaft 3 downstream of the stationary blade 1 in a flow direction of a working fluid. A casing 7 that constitutes a flow path wall surface is disposed on the outer peripheral side of a leading end of the moving blade 2.

The foregoing configuration causes a main stream of steam as a working fluid to be accelerated during its passage through the stationary blade 1 and to impart energy to the moving blade 2 to thereby rotate the rotor shaft 3.

When a wet steam state develops in the main stream of the steam as the working fluid in, for example, a low-pressure turbine having the above-described structure, droplets contained in the steam main stream affix to the stationary blade 1 and gather together on the blade surface to thereby form a liquid film. The liquid film flows in a direction of force defined by a resultant force of pressure and a shearing force acting on an interface the liquid film and steam and moves to a position near a trailing edge end of the stationary blade. Reference numeral 11 in FIG. 1 denotes a flow of the moving liquid film. The liquid film that has moved to the position near the trailing edge end of the blade becomes droplets 13 that are splashed with the steam main stream toward the moving blade 2.

Reference is made to FIG. 2. When steam stream 10 flows between the stationary blades, the droplets affix to the stationary blade 1 and gather together on the surface of the stationary blade 1 to develop into a liquid film 12. The liquid film 12 that has developed on the blade surface of the stationary blade 1 moves to the blade trailing edge end and splashes as the droplets 13 therefrom. The splashing droplets 13 collide with the moving blade 2 disposed downstream of the stationary blade 1, forming a cause of erosion eroding the surface of the moving blade 2 or of a loss as a result of the droplets 13's impeding rotation of the moving blade 2.

On the basis of the foregoing, the following describes in detail an embodiment of the present invention with reference to FIGS. 3 to 8.

The embodiment pertains to the stationary blade 1 shown in FIG. 1 to which the present invention is applied.

Figure 3:
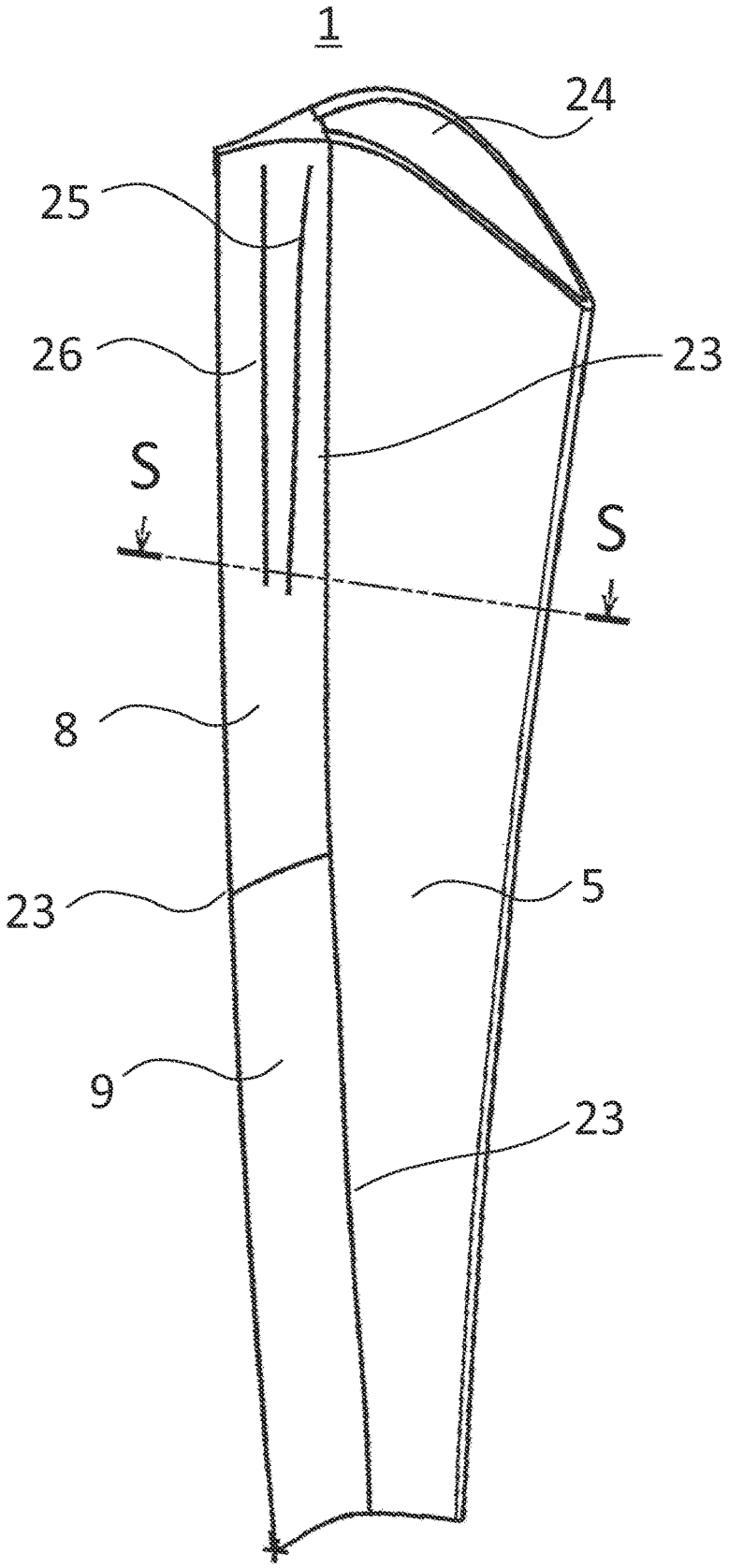
FIG. 3 is a schematic perspective view showing a stationary blade according to an embodiment of the present invention, as viewed from a pressure side of the stationary blade.
Figure 4:
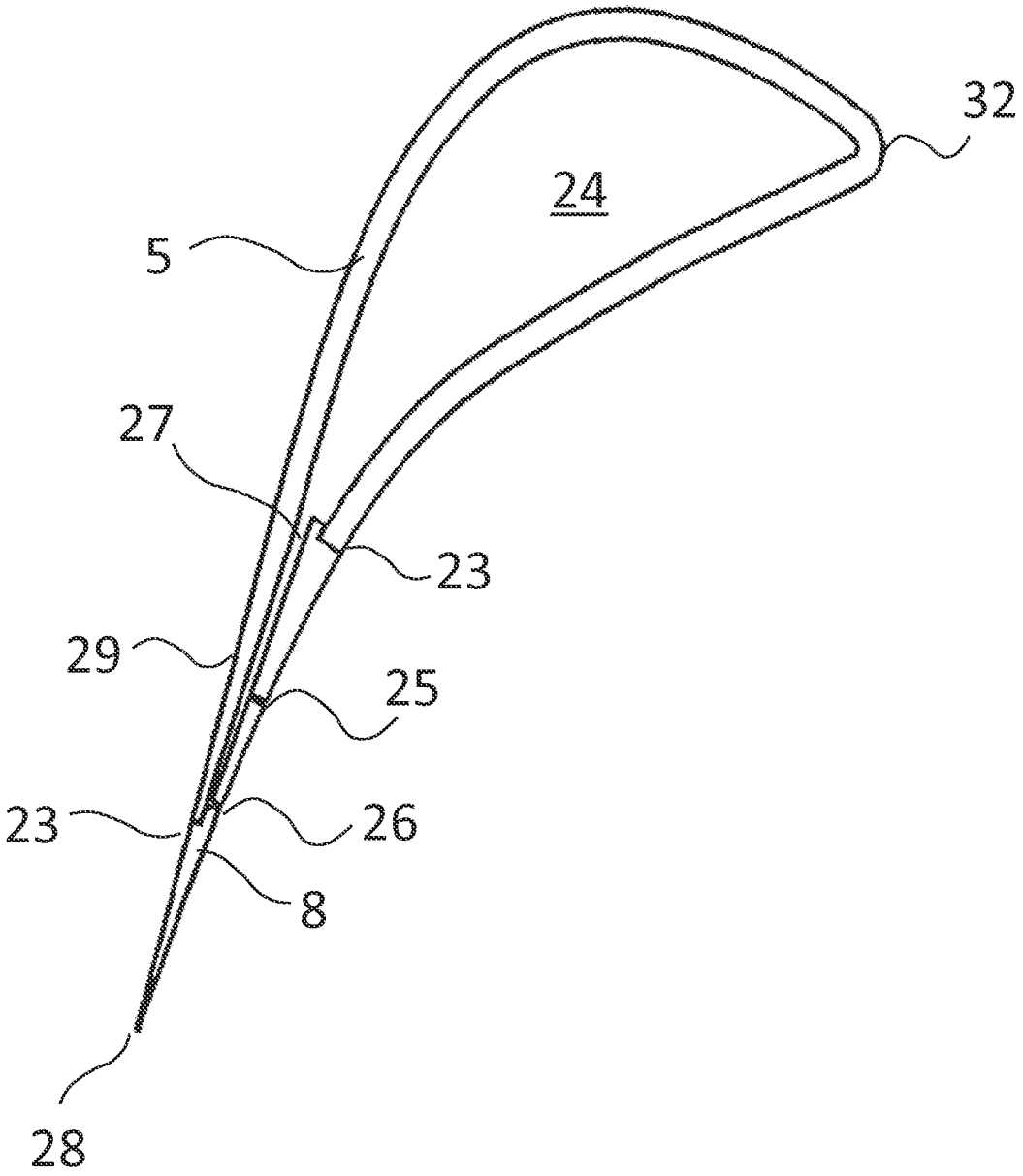
FIG. 4 is a cross-sectional view showing a blade, taken along line S-S in FIG. 3, viewed from the arrow direction.
Figure 5:
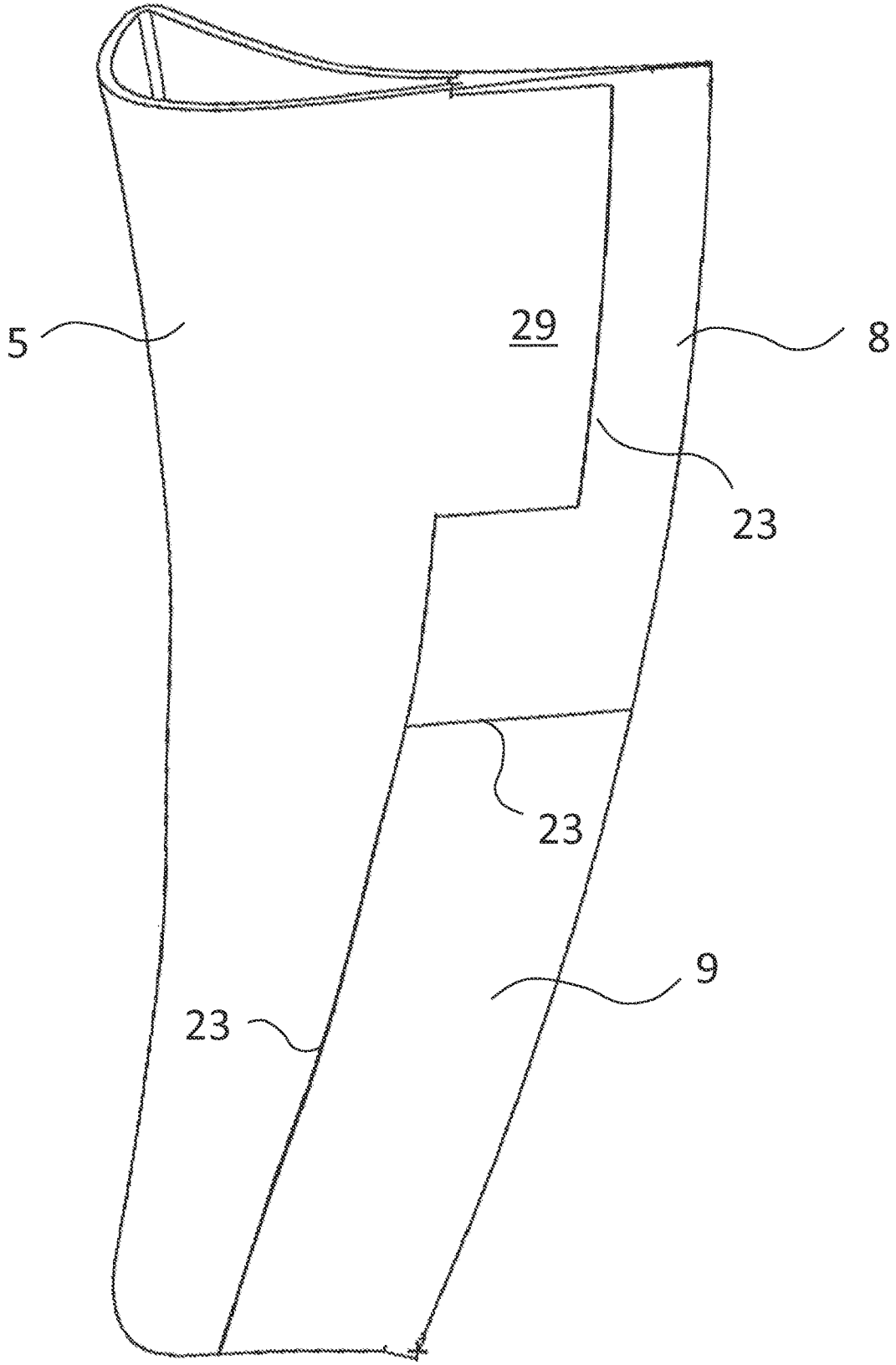
FIG. 5 is a schematic perspective view showing the stationary blade according to the embodiment of the present invention, as viewed from a suction side of the stationary blade.
Figure 6:
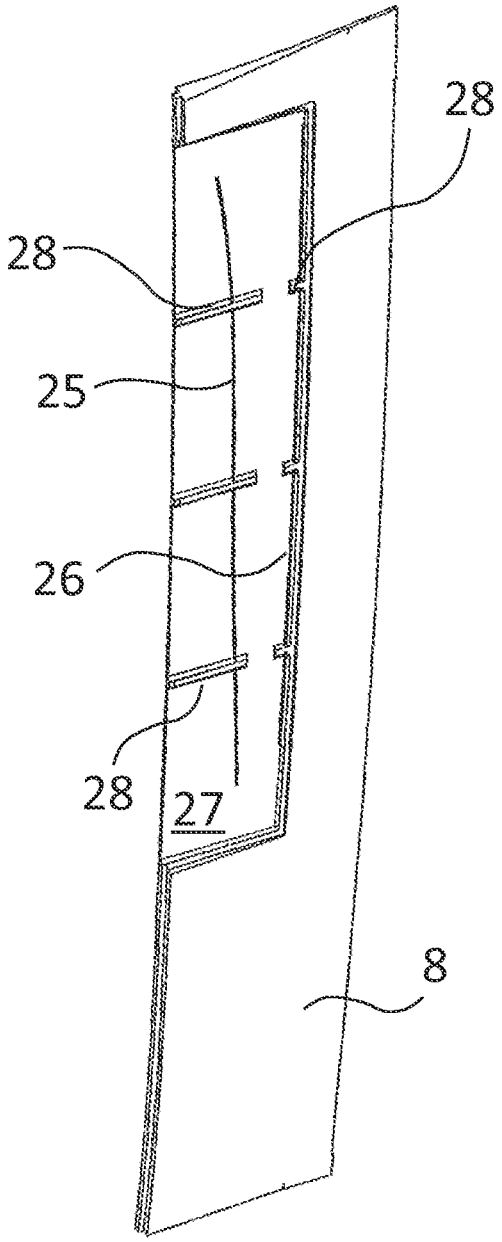
FIG. 6 is a schematic perspective view showing an upper portion of a blade tail section of the stationary blade according to the embodiment of the present invention.
Figure 7:
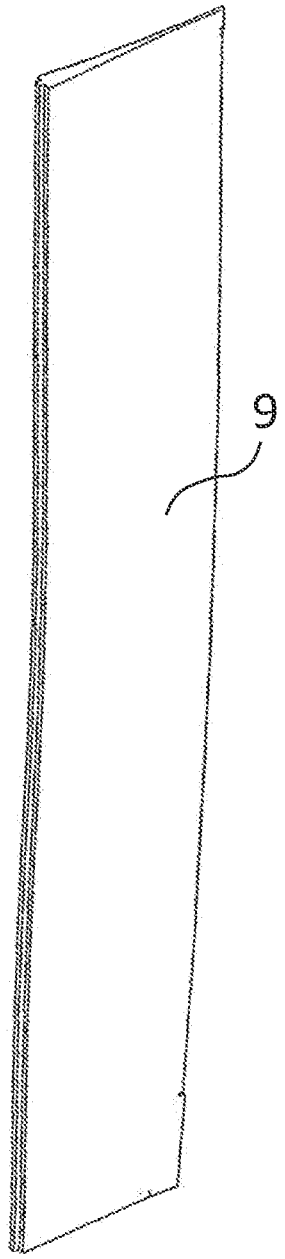
FIG. 7 is a schematic perspective view showing a lower portion of the blade tail section of the stationary blade according to the embodiment of the present invention.
Figure 8:
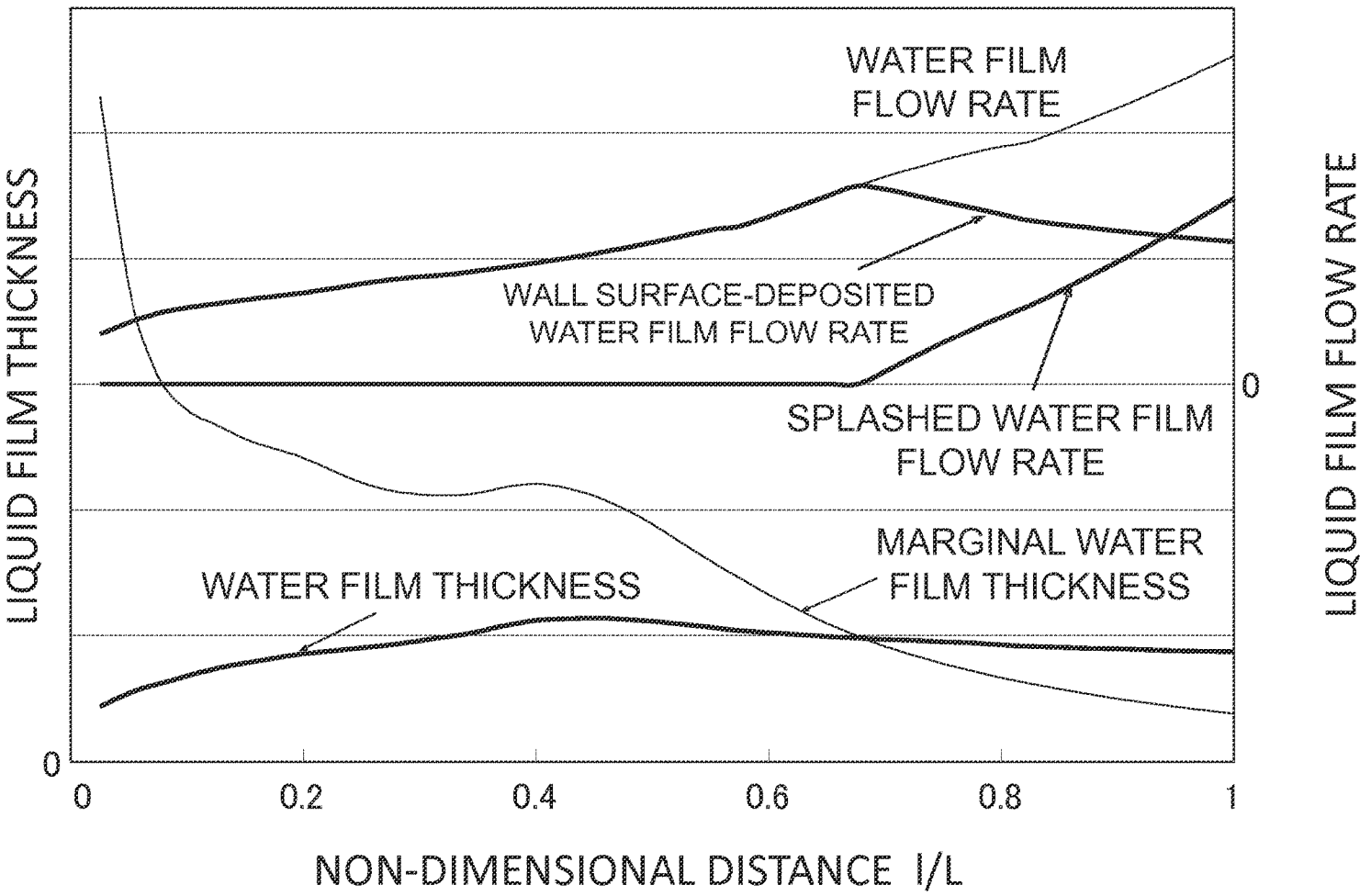
FIG. 8 is a diagram showing a relation between a thickness and a flow rate of a liquid film formed on the blade surface.

FIG. 3 is a schematic perspective view showing the stationary blade according to the embodiment of the present invention, as viewed from a pressure side of the stationary blade. FIG. 4 is a cross-sectional view taken along the dash-double-dot line (S-S) in FIG. 3. FIG. 5 is a schematic perspective view showing the stationary blade, as viewed from a suction side of the stationary blade. FIG. 6 is a schematic perspective view showing an upper portion of a blade tail section of the stationary blade, as viewed from the suction side of the stationary blade. FIG. 7 is a schematic perspective view showing a lower portion of the blade tail section. FIG. 8 is a diagram showing a thickness of a liquid film formed on the wall surface and a liquid film thickness when a relative Weber number is 0.78 (splash marginal liquid film thickness). Throughout the foregoing drawings including FIGS. 1 and 2, like reference numerals designate the same or functionally similar elements.

As shown in FIGS. 3 to 5, the stationary blade 1 is a joint assembly that joins a main unit 5 having a hollow structure with the blade tail section formed separately from the main unit 5, the blade tail section including a blade tail upper portion 8 and a blade tail lower portion 9.

As shown in FIGS. 3 to 5 and, in particular, FIG. 4, the main unit 5 is formed through plastic deformation by, for example, bending and has a hollow blade structure having a hollow section 24 thereinside. The main unit 5 is mounted on the outer peripheral side diaphragm 4 and on the inner peripheral side diaphragm 6 by welding.

Reference is made to FIGS. 3 and 5. As described earlier, the blade tail section includes the blade tail upper portion 8 and the blade tail lower portion 9 welded to each other at a weld line 23. The blade tail upper portion 8 has slits 25 and 26 formed therein. The blade tail lower portion 9 is formed of a solid member.

Referring to FIGS. 5 and 6, the blade tail upper portion 8 is formed by connecting a blade suction-side metal plate to a blade pressure-side metal plate. The blade suction-side metal plate is formed by forming a metal block into a blade tail section shape. The blade pressure-side metal plate has ribs 28 for a recess 27 formed therein on the side adjacent to the blade suction-side metal plate. The blade suction-side metal plate and the blade pressure-side metal plate are connected to each other via, for example, the ribs 28.

The slits 25 and 26 that appear on a surface of the blade tail upper portion 8 on the blade pressure side are formed at a portion that corresponds to the recess 27 on the blade suction side (on the inside of the blade) as shown in FIG. 6. This arrangement, when viewed from the blade suction side surface as shown in FIG. 5, results in the recess 27 being a shoulder (a suction-side protrusion 29). Specifically, the two slits 25 and 26 are formed in a surface opposite to the shoulder.

Referring to FIG. 6, a first slit 25 of the two slits 25 and 26 is disposed at a central portion of the recess 27 and a second slit 26 is disposed at a position close to an end in a height direction of the recess 27.

Referring also to FIG. 6, the ribs 28 are disposed at three places in a blade height direction, the ribs 28 extending in the blade flow direction. Each of the ribs 28 at the three places is divided partially so that spaces defined by an end of the recess 27 and a rib and by two adjacent ribs are uniform in pressure in the height direction.

As shown in FIG. 5, the recess 27 is covered so at to be lidded by the suction-side protrusion 29 of the blade main unit 5, so that the suction-side protrusion 29 assumes a blade surface on the blade suction side.

As shown in FIG. 4, the suction-side protrusion 29 of the blade main unit 5 and the recess 27 in the blade tail upper portion 8 provide the blade tail upper portion 8 with a space that joins to the hollow section 24 of the blade main unit 5. This arrangement results in the following: specifically, the space formed by the suction-side protrusion 29 and the recess 27 in the blade tail upper portion 8 communicates with an outside of the blade through only the slits 25 and 26 formed on the pressure side of the blade tail upper portion 8.

As shown in FIG. 7, the blade tail lower portion 9 has no slits. The blade tail lower portion 9 is formed of a solid member to facilitate machinability.

If the blade tail lower portion also needs to have a slit, the blade tail lower portion is formed to have a structure identical to the structure of the blade tail upper portion. In this case, the blade main unit also has a suction-side protrusion 29 on the suction side in the blade tail lower portion.

The following describes with reference to FIG. 8 the positions at which the first slit 25 and the second slit 26 are disposed.

The liquid film formed on the blade surface becomes unsteady when the steam flow velocity increases and part of the liquid film splashes from the blade surface. This phenomenon of the liquid film being unsteady is known to develop when the relative Weber number $Wr=0.5\times\rho h(U-W)\times(U-W)/\sigma$ is equal to, or greater than, 0.78, where $\rho$ is steam density, h is liquid film thickness, U is steam flow velocity, W is liquid film flow velocity, and $\sigma$ is liquid film surface tension.

Specifically, disposing the slits at positions that result in the relative Weber number being equal to, or greater than, 0.78 causes part of the liquid film to splash into the flow path and is thus not effective in removing the wet content.

Both the first slit 25 and the second slit 26 machined and formed in the blade tail upper portion 8 thus need to be disposed at positions that result in the relative Weber number of the liquid film flow being less than 0.78.

In FIG. 8, the abscissa represents a non-dimensionalized distance that is a distance 1 measured from an airfoil leading edge end 32 shown in FIG. 4 along the blade surface to the position of any point in the blade surface, non-dimensionalized by a distance L measured from the airfoil leading edge end 32 along the blade surface to a trailing edge end 28 shown in FIG. 4.

In FIG. 8, at positions at which the splash marginal water film thickness is thinner than a thickness of the water film produced on the blade surface, the liquid film is unable to remain sticking to the blade surface and providing the slits does not completely remove the wet content. For the slit positions shown in FIGS. 3 and 4, the upstream first slit 25 is disposed such that $l/L=0.65$ to 0.75. In a range downstream of $l/L=0.65$ to 0.75, the steam flow velocity increases greatly and a large amount of liquid film is produced again in the downstream region even with the liquid film removed 100% by the first slit 25. Because the relative Weber number of this liquid film exceeds the splash marginal water film thickness again, the second slit 26 is disposed at a position that falls within a range of $1/L=0.75$ to 0.9. While the liquid film is produced downstream of the second slit 26, the two slits 25 and 26 can remove 80% or more of the liquid film produced on the stationary blade surface.

The steam turbine according to the embodiment of the present invention described above includes a turbine stage that comprises the stationary blade 1 and the moving blade 2 disposed downstream in the flow direction of the working fluid of the stationary blade 1. The stationary blade 1 includes the main unit 5 having a hollow blade structure formed from a metal plate by plastic forming. The stationary blade 1 includes the blade tail section. In the blade tail upper portion 8, the metal plate has the concave-shaped recess 27 and the ribs 28 formed on the inner surface side thereof and the metal plate further has the slits 25 and 26 formed by slitting on the blade pressure side thereof, so that droplets affixed on the blade surface can be guided into the inside of the hollow blade when the blade tail section is joined to the hollow blade main unit. The recess 27 in the metal plate is covered so as to be lidded by the suction-side protrusion 29 of the suction-side metal plate from the blade suction side to thereby form a hollow blade tail section. The metal plates are welded together to the main unit 5.

The arrangements of the embodiment allow the slits for guiding the droplets affixed to the blade wall surface into the inside of the blade to be disposed at positions that fall within the area achieving the splash marginal liquid film thickness. More than 80% of the liquid film produced on the stationary blade can thereby be removed, so that the erosive action on the moving blade due to erosion arising from the collision of droplets produced from the wet steam can be reduced and reliability can be enhanced.

The invention is not limited to the above embodiments disclosed and various changes, improvements, and the like may be made as appropriate. The foregoing embodiments are only meant to be illustrative, and the invention is not necessarily limited to structures having all the components disclosed.

What is claimed is:

1. A stationary blade of a steam turbine having a slit in a wall surface thereof, the slit guiding a droplet affixed to the wall surface into an inside of the stationary blade, wherein the stationary blade comprises:

a main unit having a hollow blade structure formed from a metal plate by plastic forming; and a blade tail section formed of a blade suction-side metal plate overlapping a blade pressure-side metal plate, the blade pressure-side metal plate having a recess covered by a part of the main unit formed only in a blade tail upper portion only in a blade tail upper portion on a side adjacent to the blade suction-side metal plate, and wherein the slit is disposed at a position at which the recess in the blade pressure-side metal plate of the blade tail section is disposed.

2. The stationary blade of a steam turbine according to claim 1, wherein the blade tail section has the blade tail upper portion having the recess and a blade tail lower portion formed of a solid member.

3. The stationary blade of a steam turbine according to claim 1, wherein the recess has a rib disposed therein.

4. The stationary blade of a steam turbine according to claim 2, wherein the recess has a rib disposed therein.

5. The stationary blade of a steam turbine according to claim 1, wherein the part of the main unit is a protrusion at a position at which the main unit is joined to the recess in the blade pressure-side metal plate.

6. The stationary blade of a steam turbine according to claim 2, wherein the part of the main unit is a protrusion at a position at which the main unit is joined to the recess in the blade pressure-side metal plate.

7. The stationary blade of a steam turbine according to claim 3, wherein the part of the main unit is a protrusion at a position at which the main unit is joined to the recess in the blade pressure-side metal plate.

8. The stationary blade of a steam turbine according to claim 4, wherein the part of the main unit is a protrusion at a position at which the main unit is joined to the recess in the blade pressure-side metal plate.

9. The stationary blade of a steam turbine according to claim 1, wherein the slit is one of a first slit and a second slit, and, when a distance measured from an airfoil leading edge end along the blade surface to the position of any point in the blade surface is 1 and a distance measured from the airfoil leading edge end along the blade surface to a trailing edge end is L, the first slit is disposed within the range 1/L=0.65 to 0.75 and the second slit is disposed in the range 1/L=0.75 to 0.9.

10. A steam turbine comprising:

a turbine stage comprising the stationary blade of a steam turbine according to claim 1, and a moving blade installed downstream of the stationary blade in a flow direction of a working fluid.

11. A steam turbine comprising:

a turbine stage comprising the stationary blade of a steam turbine according to claim 2, and a moving blade installed downstream of the stationary blade in a flow direction of a working fluid.

12. A steam turbine comprising:

a turbine stage comprising the stationary blade of a steam turbine according to claim 3, and a moving blade installed downstream of the stationary blade in a flow direction of a working fluid.

13. A steam turbine comprising:

a turbine stage comprising the stationary blade of a steam turbine according to claim 4, and a moving blade installed downstream of the stationary blade in a flow direction of a working fluid.

14. A steam turbine comprising:

a turbine stage comprising the stationary blade of a steam turbine according to claim 5, and a moving blade installed downstream of the stationary blade in a flow direction of a working fluid.

15. A steam turbine comprising:

a turbine stage comprising the stationary blade of a steam turbine according to claim 6, and a moving blade installed downstream of the stationary blade in a flow direction of a working fluid.

16. A steam turbine comprising:

a turbine stage comprising the stationary blade of a steam turbine according to claim 7, and a moving blade installed downstream of the stationary blade in a flow direction of a working fluid.

17. A steam turbine comprising:

a turbine stage comprising the stationary blade of a steam turbine according to claim 8, and a moving blade installed downstream of the stationary blade in a flow direction of a working fluid.

* * * * *